US009175827B2

(12) United States Patent
Clore

(10) Patent No.: US 9,175,827 B2
(45) Date of Patent: Nov. 3, 2015

(54) INDICATOR LIGHT TOWER TECHNOLOGY

(71) Applicant: Lee Clore, Hastings, MN (US)

(72) Inventor: Lee Clore, Hastings, MN (US)

( * ) Notice: Subject to any disclaimer, the term of this patent is extended or adjusted under 35 U.S.C. 154(b) by 282 days.

(21) Appl. No.: 13/890,960

(22) Filed: May 9, 2013

(65) Prior Publication Data

US 2013/0314916 A1 Nov. 28, 2013

Related U.S. Application Data

(60) Provisional application No. 61/644,604, filed on May 9, 2012.

(51) Int. Cl.

| | |
|---|---|
| ***F21V 5/04*** | (2006.01) |
| *F21V 33/00* | (2006.01) |
| *H04R 1/02* | (2006.01) |
| *F21W 111/00* | (2006.01) |
| *F21Y 101/02* | (2006.01) |
| *F21Y 105/00* | (2006.01) |
| *H05B 33/08* | (2006.01) |

(52) U.S. Cl.

CPC ..... *F21V 5/04* (2013.01); *F21V 33/0052* (2013.01); *F21W 2111/00* (2013.01); *F21Y 2101/02* (2013.01); *F21Y 2105/001* (2013.01); *H04R 1/028* (2013.01); *H05B 33/0827* (2013.01)

(58) Field of Classification Search

CPC ..... F21V 5/04

See application file for complete search history.

(56) References Cited

U.S. PATENT DOCUMENTS

| | | | | |
|---|---|---|---|---|
| 5,642,933 | A * | 7/1997 | Hitora | 362/243 |
| 2004/0053663 | A1* | 3/2004 | Paulsen et al. | 463/16 |
| 2006/0044814 | A1* | 3/2006 | Ikeda | 362/382 |
| 2011/0058370 | A1* | 3/2011 | Datz et al. | 362/235 |
| 2011/0170310 | A1* | 7/2011 | Haenen et al. | 362/516 |

* cited by examiner

*Primary Examiner* — Elmito Breval

(74) *Attorney, Agent, or Firm* — Skinner and Associates; Joel Skinner

(57) ABSTRACT

A light tower or stack light including an exterior which has a cylindrical or columnar configuration including transparent or translucent panels or lenses, and a interior based on a flat, planar arrangement of light sources. The light tower translates the flat, essentially unidirectional or bidirectional arrangement of lights to a 180 to 360 degree, multidirectional light source. The light indicator tower is for use with a industrial apparatus or process to indicate the status of the apparatus or process. The tower includes a flat, planar, PCB light panel having two sides, the light panel further having a plurality of LED light sources disposed on each side of the light panel. The tower has a curvilinear light dispersing lens disposed to disperse light over a range of 360 degrees.

14 Claims, 15 Drawing Sheets

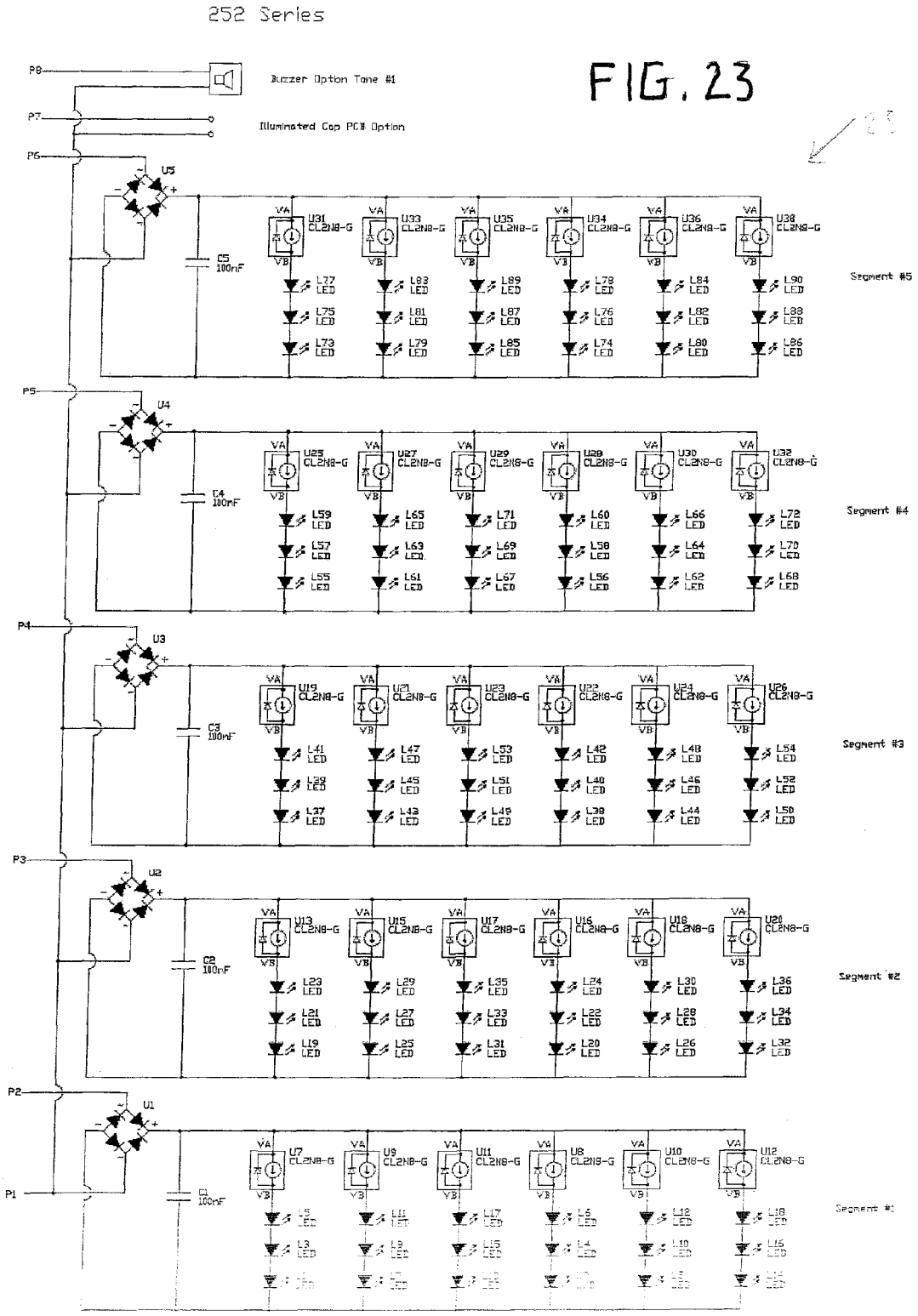
252 Series
FIG. 23
P8
Buzzer Option Tone #1
P7
Illuminated Cap PCB Option
P6
U5
C5 100nF
U31 CL2N8-G
U33 CL2N8-G
U35 CL2N8-G
U34 CL2N8-G
U36 CL2N8-G
U38 CL2N8-G
L77 LED
L83 LED
L89 LED
L78 LED
L84 LED
L90 LED
L75 LED
L81 LED
L87 LED
L76 LED
L82 LED
L88 LED
L73 LED
L79 LED
L85 LED
L74 LED
L80 LED
L86 LED
Segment #5
P5
U4
C4 100nF
U25 CL2N8-G
U27 CL2N8-G
U29 CL2N8-G
U28 CL2N8-G
U30 CL2N8-G
U32 CL2N8-G
L59 LED
L65 LED
L71 LED
L60 LED
L66 LED
L72 LED
L57 LED
L63 LED
L69 LED
L58 LED
L64 LED
L70 LED
L55 LED
L61 LED
L67 LED
L56 LED
L62 LED
L68 LED
Segment #4
P4
U3
C3 100nF
U19 CL2N8-G
U21 CL2N8-G
U23 CL2N8-G
U22 CL2N8-G
U24 CL2N8-G
U26 CL2N8-G
L41 LED
L47 LED
L53 LED
L42 LED
L48 LED
L54 LED
L39 LED
L45 LED
L51 LED
L40 LED
L46 LED
L52 LED
L37 LED
L43 LED
L49 LED
L38 LED
L44 LED
L50 LED
Segment #3
P3
U2
C2 100nF
U13 CL2N8-G
U15 CL2N8-G
U17 CL2N8-G
U16 CL2N8-G
U18 CL2N8-G
U20 CL2N8-G
L23 LED
L29 LED
L35 LED
L24 LED
L30 LED
L36 LED
L21 LED
L27 LED
L33 LED
L22 LED
L28 LED
L34 LED
L19 LED
L25 LED
L31 LED
L20 LED
L26 LED
L32 LED
Segment #2
P2
U1
P1
C1 100nF
U7 CL2N8-G
U9 CL2N8-G
U11 CL2N8-G
U8 CL2N8-G
U10 CL2N8-G
U12 CL2N8-G
Segment #1

| | *5 Pin M12 | | **db9 D-Shell | | Flying Leads |
|---|---|---|---|---|---|
| | Color | Pin # | Color | Pin # | Color |
| Voltage Source | WHT | 1 | WHT | 1 | WHT |
| Segment 1 (S1) | BRN | 2 | BRN | 2 | BRN |
| Segment 2 (S2) | BLK | 3 | GRN | 3 | GRN |
| Segment 3 (S3) or Illuminated Buzzer Option (BL) | GRY | 4 | YLW | 4 | YLW |
| For units with 3 Standard Segments + Illuminated Buzzer Cap, Reference 3 Segment Wiring in diagram below as this configuration ships with an 8 Wire Conductor Cable | | | | | |
| Buzzer (BZR) | BLU | 5 | BLU | 9 | BLU |

| | **8 Pin M12 | | ***db9 D-Shell | | ****Flying Leads |
|---|---|---|---|---|---|
| | Color | Pin # | Color | Pin # | Color |
| Voltage Return | WHT | 1 | WHT | 1 | WHT |
| Segment 1 (S1) | BRN | 2 | BRN | 2 | BRN |
| Segment 2 (S2) | GRN | 3 | GRN | 3 | GRN |
| Segment 3 (S3) | YLW | 4 | YLW | 4 | YLW |
| Segment 4 (S4) | GRY | 5 | GRY | 5 | GRY |
| Segment 5 (S5) | PNK | 6 | PNK | 6 | PNK |
| Illuminated Buzzer Option (BL) | RED | 7 | RED | 7 | RED |
| Buzzer (BZR) | BLU | 8 | BLU | 8 | BLU |

INDICATOR LIGHT TOWER TECHNOLOGY

CROSS REFERENCE TO RELATED APPLICATIONS, IF ANY

This application claims the benefit under 35 U.S.C. §119 (e) of U.S. Provisional Patent Application Ser. No. 61/644,604, filed May 9, 2012, which is hereby incorporated by reference.

37 C.F.R. §1.71(E) AUTHORIZATION

A portion of the disclosure of this patent document contains material which is subject to copyright protection. The copyright owner has no objection to the facsimile reproduction by anyone of the patent document or the patent disclosure, as it appears in the US Patent and Trademark Office patent file or records, but otherwise reserves all copyright rights whatsoever.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to indicator and signaling systems, apparatus and methods. Particularly, the invention relates to an indicator light tower for use for example with machine automation systems to show their status to users. Light towers are also known as stack lights, And-On Lights, Machine Status Lights, Indicator Lights and the like.

2. Background Information

Existing technology in this field is believed to have significant limitations and shortcomings.

All US patents and patent applications, and all other published documents mentioned anywhere in this application are incorporated by reference in their entirety.

BRIEF SUMMARY OF THE INVENTION

The present invention provides indicator apparatus and methods which are practical, reliable, accurate and efficient, and which are believed to constitute an improvement over the background technology.

The exterior of indicator has a cylindrical or columnar configuration including transparent or translucent panels or lenses. The interior of the indicator is based on a flat, planar arrangement of light sources (single or multi-colored). The invention provides a means of translating the flat, essentially unidirectional or bidirectional arrangement of lights to a 360 degree, multidirectional light source.

In one aspect, the invention provides a light indicator comprising a flat light panel having at least one light source disposed on at least one side of the flat light panel, a curvilinear light dispersing lens disposed near the at least one light source to disperse light emitted from the at least one light source over a range of at least 180 degrees, and means to actuate the light source.

In another aspect the invention provides: (a) a flat, planar, PCB light panel having two sides, the light panel further having a plurality of LED light sources disposed on each side of the light panel, the light sources being disposed in groups having at least two light sources per group; (b) a curvilinear light dispersing lens disposed near each group of one light sources to disperse light emitted from the at least one light source over a range of at least 360 degrees; (c) a frame for holding each light dispersing lens; and (d) means to actuate the light source.

In a further aspect, the invention provides a light indicator tower is disclosed for use with a industrial apparatus or process to indicate the status of the apparatus or process, including (a) a flat, planar, PCB light panel having two sides, the light panel further having a plurality of LED light sources disposed on each side of the light panel, the light sources being disposed in groups having at least two light sources per group, the groups of light sources being spatially separated a predetermined distance; (b) a curvilinear light dispersing lens disposed near each group of one light sources to disperse light emitted from the at least one light source over a range of at least 360 degrees, each light dispersing lens including a light dispersing film member and a rigid, light transmissive cover member; (c) a cylindrical frame for holding the light panel in a vertical orientation and for holding each light dispersing lens proximate a group of light sources, the frame having a base electrically communicatively connected to a bottom end of the PCB light panel and lens supporting array vertically and upwardly extending from the base, the lens supporting array having a plurality of apertures for supporting the light dispersing lenses; and (d) circuitry, integrated into the PCB light panel, to actuate the groups of light sources and indicate the status of the apparatus or process.

The present invention is believed to involve novel elements, combined in novel ways to yield more than predictable results. The problems solved by the invention were not fully recognized in the prior art.

The aspects, features, advantages, benefits and objects of the invention will become clear to those skilled in the art by reference to the following description, claims and drawings.

BRIEF DESCRIPTION OF THE SEVERAL VIEWS OF THE DRAWING

FIG. 23 is a schematic diagram of an embodiment of the circuitry of the light tower of the invention.

DETAILED DESCRIPTION

Figure 1:
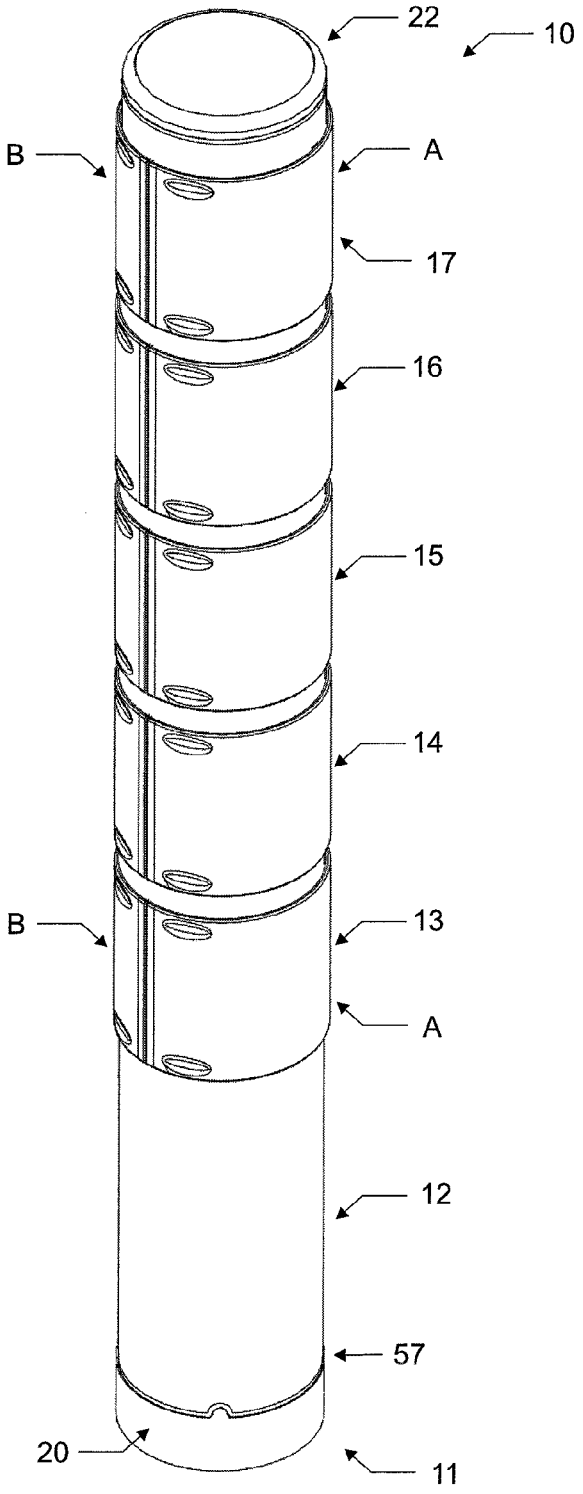
FIG. 1 is a perspective view of an embodiment of an indicator light tower of the present invention.
Figure 2:
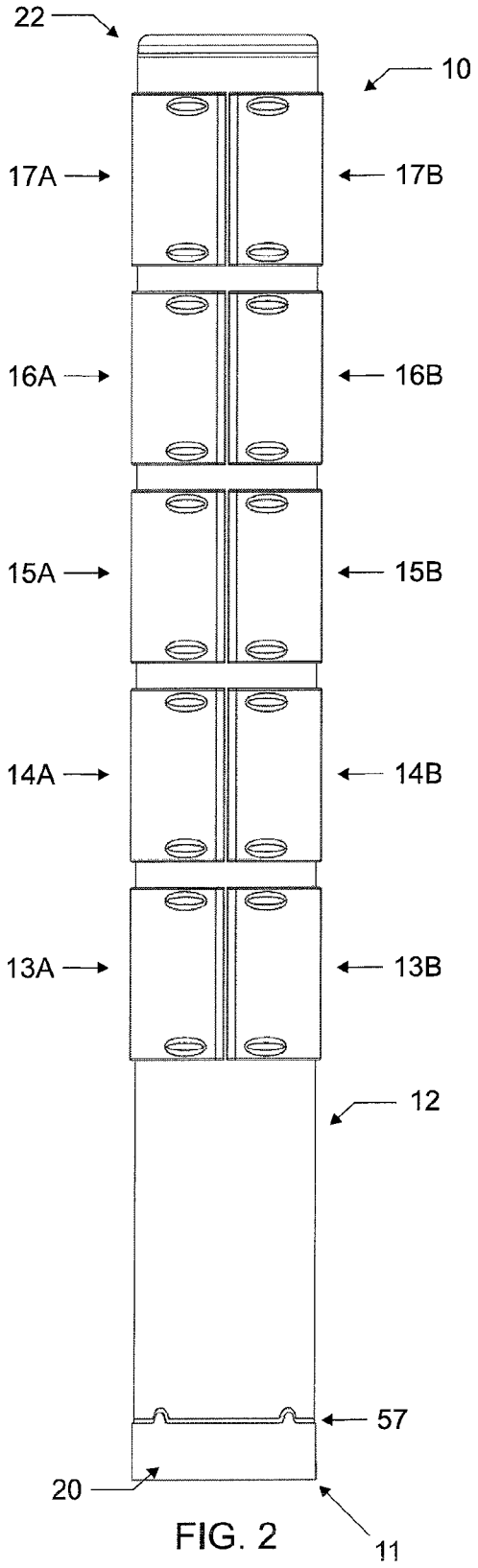
FIG. 2 is a front view thereof.
Figure 3:
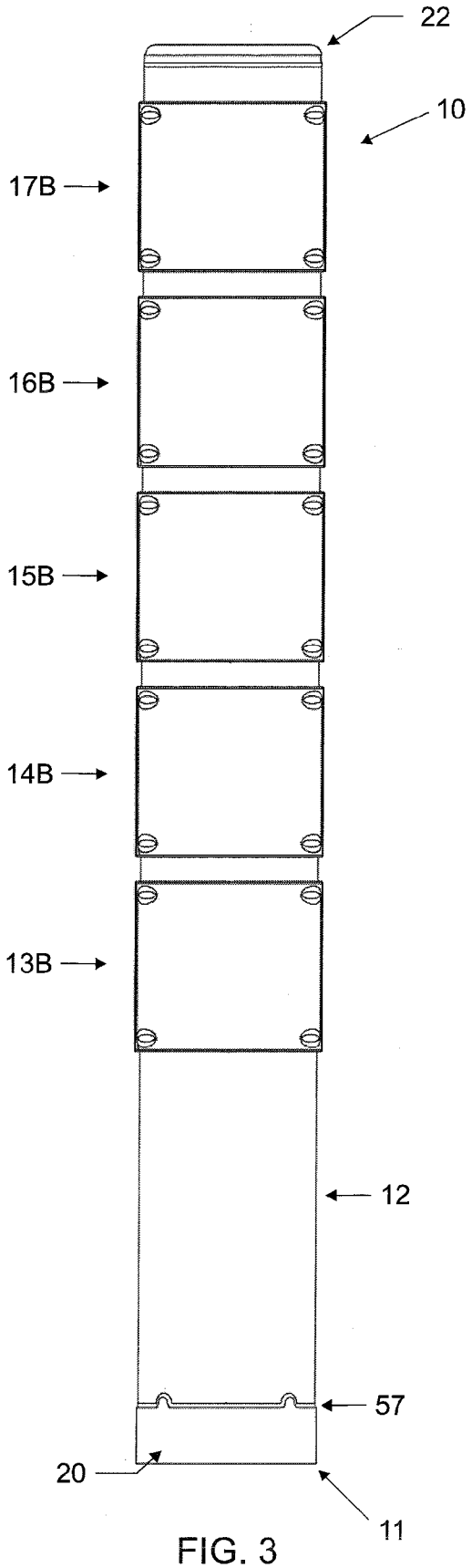
FIG. 3 is a side view thereof.
Figure 4:
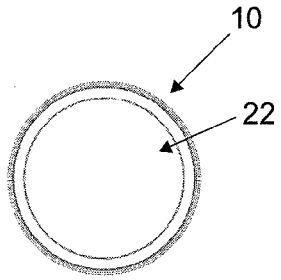
FIG. 4 is a top view thereof.
Figure 5:
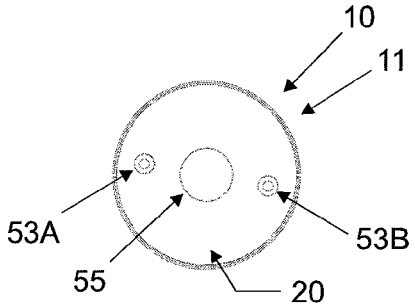
FIG. 5 is a bottom view thereof.

The exterior of indicator has a cylindrical or columnar configuration including transparent or translucent panels or lenses. The interior of the indicator is based on a flat, planar arrangement of light sources. The invention provides a means of translating the flat, essentially unidirectional or bidirectional arrangement of lights to a 180 to 360 degree, multidirectional light source. The preferred light sources are light emitting diodes LED's, preferably of single color in an illuminated segment. It is possible to have up to three (3) colors in a single segment. This would entail a bank of each Red, Yellow, and Green LEDs on both side of the PCB in a single illuminated segment where the lens is either clear with diffusing film or a diffusing polycarbonate (i.e. RTP resin). Only one (1) color would be active at any one time in such embodiment.

FIGS. 1-5 show an embodiment of the light tower 10 of the present invention. This embodiment of the light tower 10 has a flat cap, no top light and no buzzer. The tower 10 comprises a base assembly 11, a shell assembly 12 and a plurality of curvilinear light dispersing lens assemblies 13A/B to 17A/B, which can vary depending upon the number of status indications desired to be illuminated and signaled. The tower 10 has an elongated, cylindrical configuration with a preferred diameter of between 1.63 inches (41.5 mm) to about 2.65 inches (67 mm). The tower has a length of between 7.25 inches (185 mm) to about 15.25 inches (387 mm) depending mainly on the number of lens assemblies 13. In the five (5) light/lens indication state embodiment shown, the length or height of the tower 10 is 15.25 inches (387 mm). A single light/lens indication state tower (not shown) would be constructed with a length of about 7.25 inches (185 mm) utilizing the teachings of the invention.

Figure 6:
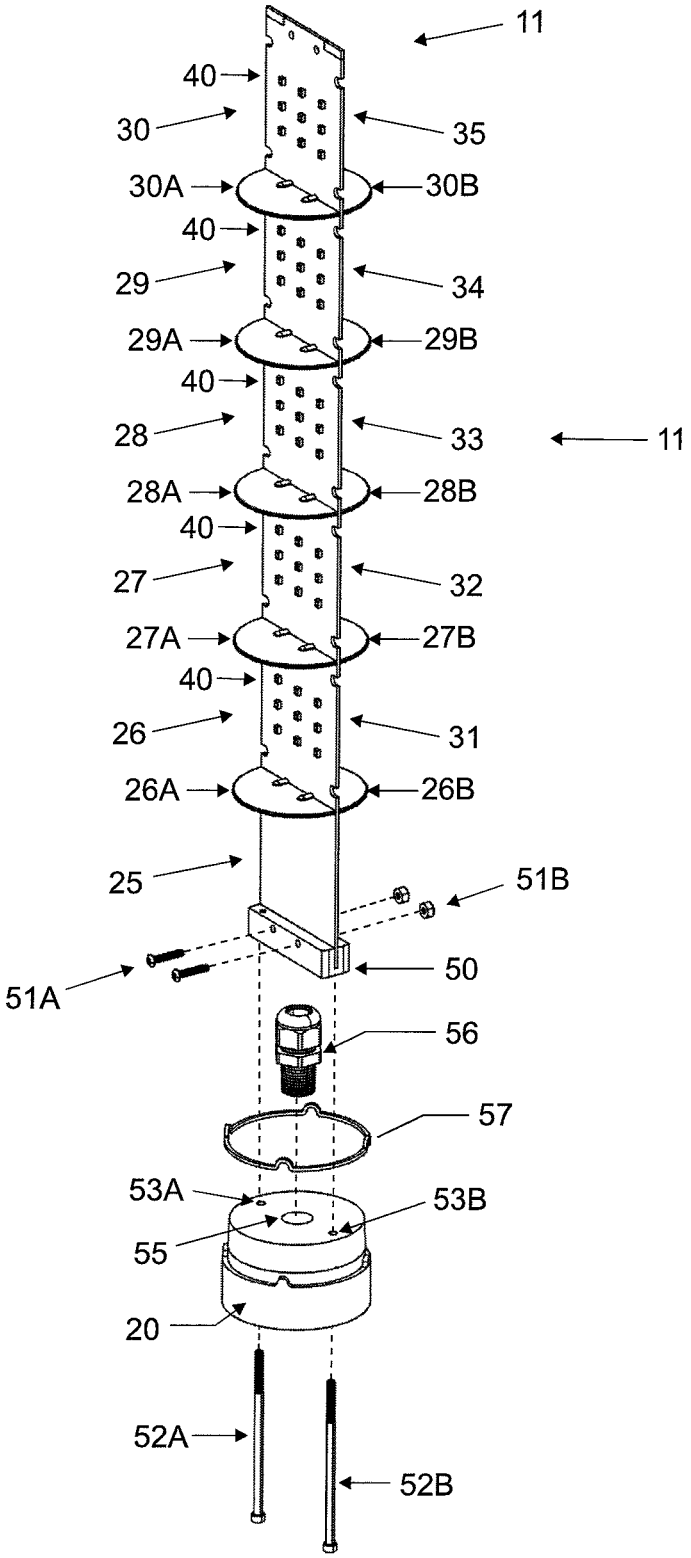
FIG. 6 is an exploded view of an embodiment of the base assembly of the light tower.
Figure 7:
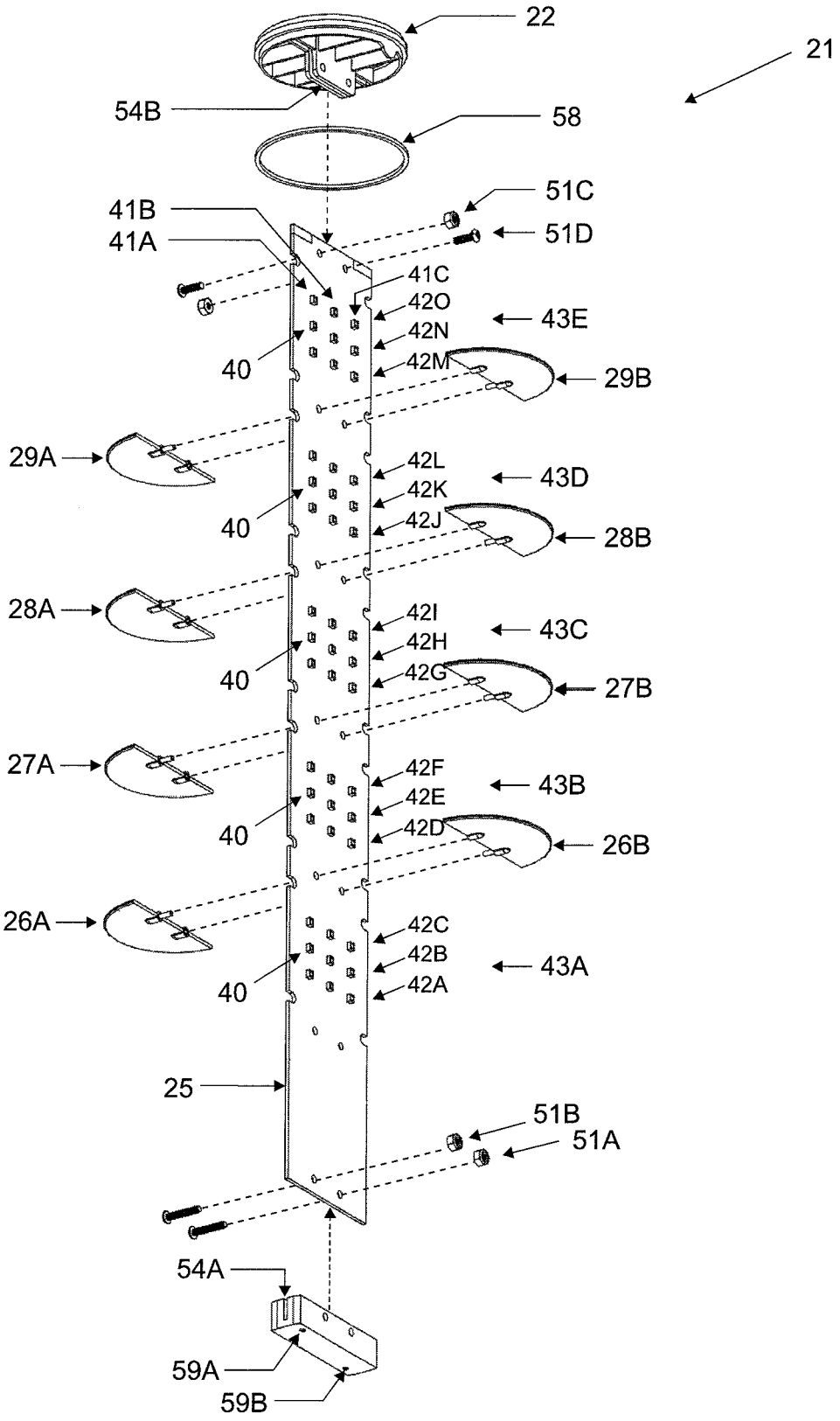
FIG. 7 is an exploded view of an embodiment of the lighted PCB assembly of the base assembly of the light tower.

Referring also to FIGS. 6 and 7, a preferred embodiment of the base assembly 11 of the light tower 10 preferably principally comprises a cylindrical bottom base cap 20, a planar light panel or array 21, and a top cap 22. The base cap 20 has a cylindrical configuration with a diameter of approximately 1.63 inches (41.5 mm) to 2.65 inches (67 mm). The base cap 20 is constructed of a durable, rigid material or composite material, and such as solid cast aluminum or polycarbonate/aluminum. The planar light array 21 comprises a lighted printed circuit board (PCB) member 25 and a plurality of sets of barriers 26-30 which consist of half barriers A and B, and divide the lighted PCB member 25 into light segments 31-36, each with two sides A and B. The lighted PCB member 25 has a flat, planar structure with a predetermined width and a predetermined length that is variable depending upon the number of indication sets and lens assemblies. The lighted PCB member 25 has a plurality of light sources 40 disposed on each side A and B. In the preferred embodiment, the light sources are light emitting diodes (LEDs). In the embodiment shown, there are a total of ninety (90) LEDs 40, with forty five (45) LEDs 40 disposed on each side the PCB member 25. The LEDs 40 are preferably arranged in longitudinal (vertical) columns 41A, B and C and lateral (horizontal) rows 42 A-O. The LEDs 40 are further preferably arranged in groups or clusters of nine (9) 43A, B, C, D and E separated (vertically or longitudinally) a predetermined distance by regions which contain no light sources. The LEDs 40, and groups 43A-E thereof, are electrically communicatively connected via printed circuits of the PCB to power and control means described further below, and are each adapted to emit light of a predetermined intensity upon being powered for a predetermined time, preferably as clusters 43. Significantly, although the LEDs 40 are arranged on the flat plane of each side of the PCB, the combination of features of the tower 10 transmit light indications in a non-planer manner so that they can be easily and reliably visualized and perceived by users. The barriers 26-30 are disposed at predetermined positions along the length of the assembly 11 to assist in separating the light groups 43 into separate indication regions. Each barrier 26-30 has a first half A disposed on one side of the PCB and a second half B disposed on the opposite side. The barrier halves A and B have a semi-circular configuration with a flat face that abuts the PCB and a curved face that complements the cylindrical outer periphery of the tower 10. The barriers 26-30 are disposed at the open regions of the PCB between the light clusters 43A-E and act as a vertical barrier to light from one cluster being transmitted up or down the tower into the region of an adjacent cluster.

A PCB base connector 50 is disposed at the bottom of PCB member 25. The PCB member 25 is preferably secured to the base connector 50 via two laterally disposed securement screw and nut pairs 51A-B which extend through apertures in the board 25. The base connector 50 is connected to the base cap 20 via two longitudinally disposed securement screws 52 A/B which extend through apertures 53A-B in the base 20 and into threaded apertures 59 A/B in the bottom of the connector 50. PCB member 25 mates with slot 54A in the connector 50. In addition to physically supporting the PCB 25, the connector 50 also serves electrically communicatively connect the PCB 25 circuitry to the power and control circuitry of the apparatus described below. Base 20 includes central aperture 55 through which a power and communication cord(s), cable(s) or the like (not shown) extend(s) to mate with cable/cord strain relief grip 56. The grip 56 holds the end of the cord/cable in place for electrical communication with the connector 50. A seal ring 57 is disposed on the base 20 to seal, in connection with the shell assembly 12, the interior of the tower from dust, dirt, moisture, fluids and the like. The ring 57 has one or more anti-torque nubs that mate with anti-torque detents on the base 20. The top cap 22 has a circular configuration that is coextensive with the diameter of the tower 10. The bottom surface of the cap 22 has a slot 54B that mates with the PCB member 25, secured by screw nut pairs 51C/D through apertures in board 25, and assists in holding it in a stable position. Seal ring 58 is disposed at the top of the tower 10 for sealing cap 22.

Figure 8:
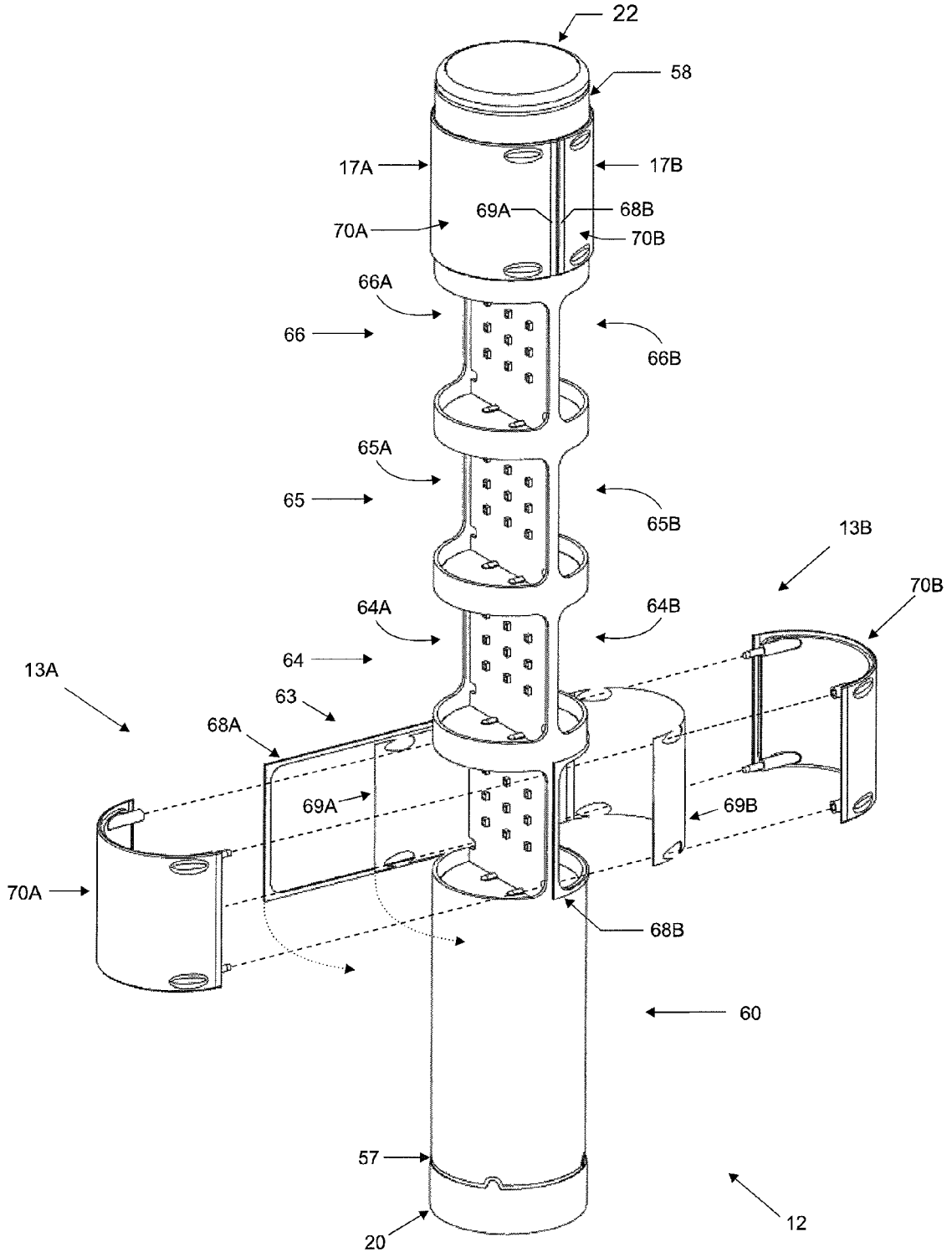
FIG. 8 is an exploded view of an embodiment of a lens assembly of the light tower.
Figure 9:
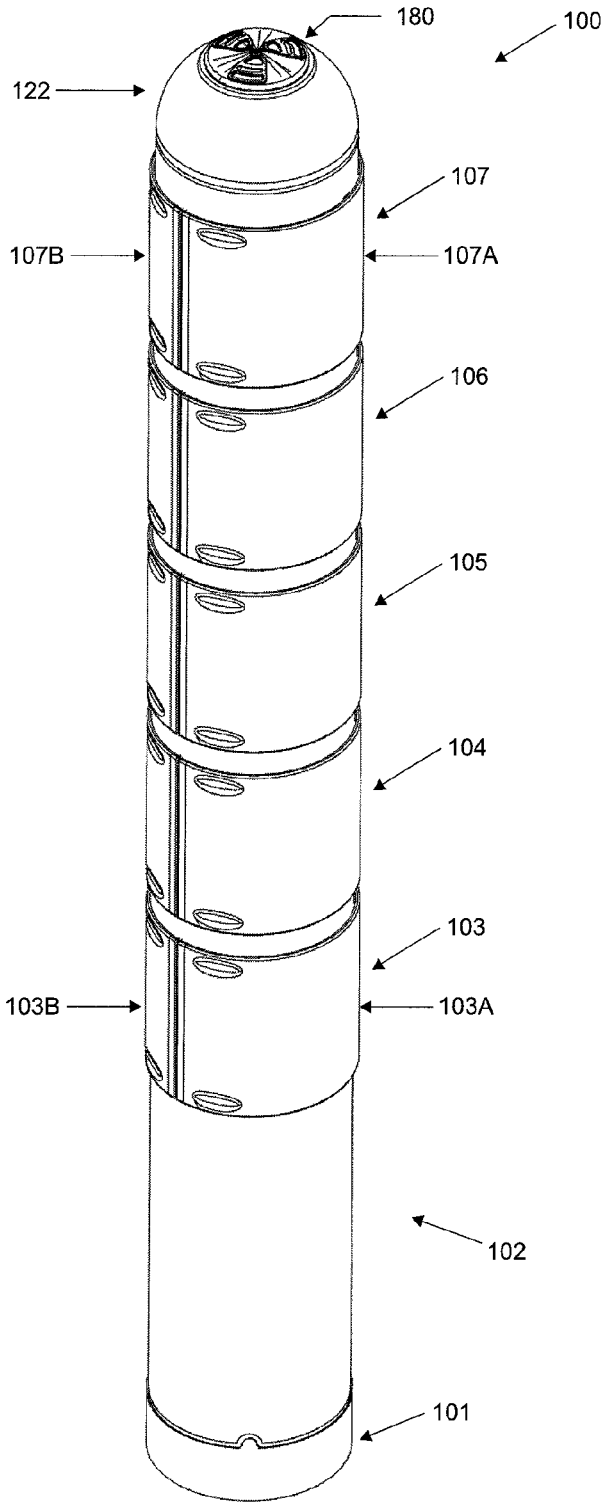
FIG. 9 is a perspective view of an alternative embodiment of the light tower of the present invention.
Figure 10:
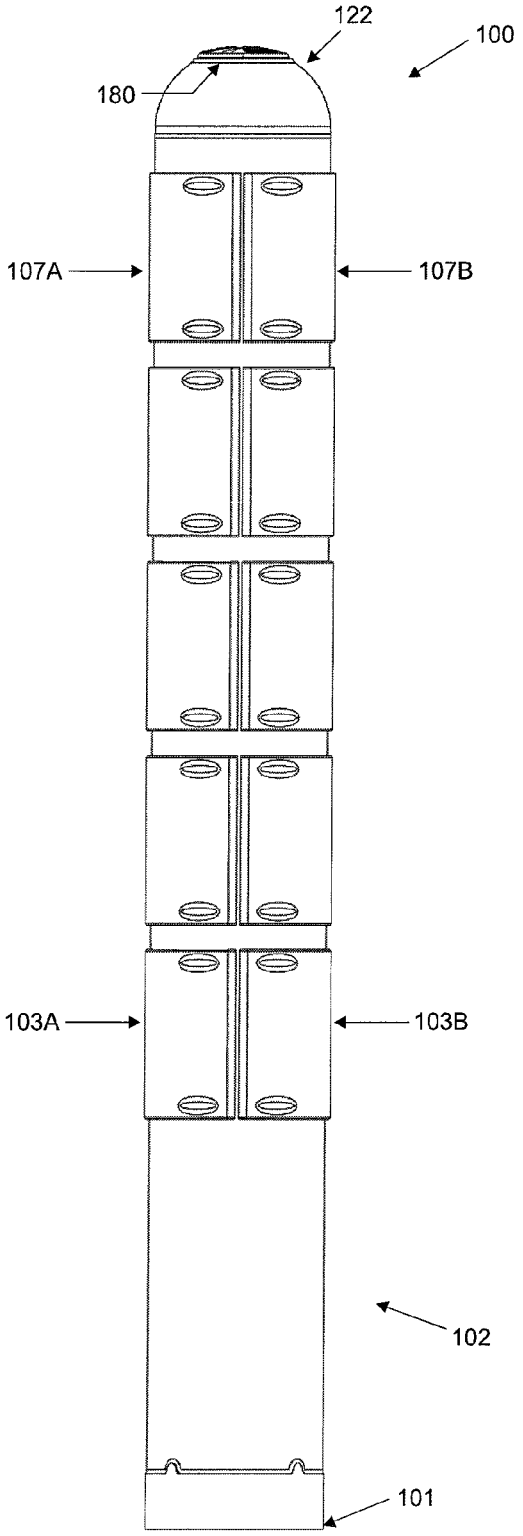
FIG. 10 is a front view thereof.
Figure 11:
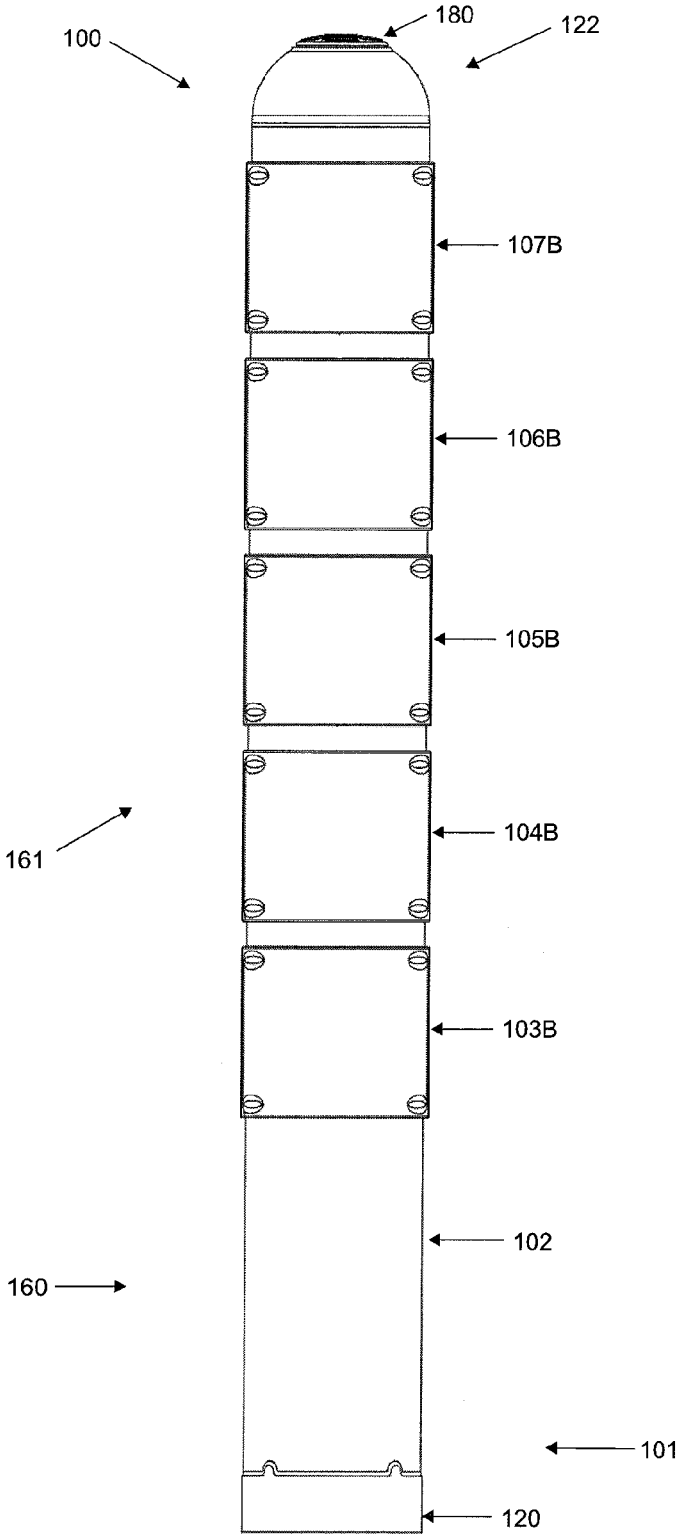
FIG. 11 is a side view thereof.
Figure 12:
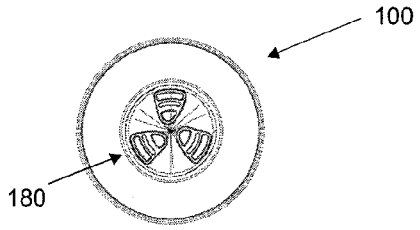
FIG. 12 is an a top view thereof.
Figure 13:
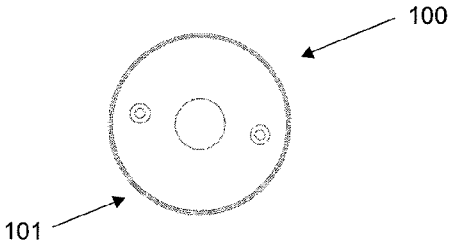
FIG. 13 is an a bottom view thereof.

Referring also to FIG. 8, the shell assembly 12 has a cylindrical configuration with a bottom region 60 that has a wall with no apertures and a top region 61 that has a plurality of hemi-cylindrical aperture sets 63A/B to 67A/B. Aperture sets 63-67 expose the light clusters of the base assembly 11. The curvilinear light dispersing lens assemblies 13A/B to 17A/B are constructed and arranged to cover the aperture sets 63A/B to 67A/B. Each assembly 13-17 includes a set A and B (for each side of the tower 10) comprising a sealing gasket 68, a diffusing film 69 and a hemi-cylindrical lens 70. The gaskets 68A/B, diffusing films 69A/B, and lenses 70A/B are arranged and mated with each aperture set 63-57 as shown. The lenses 70 are preferably constructed of a plastic material, most preferably polycarbonate.

FIGS. 9-13 show an alternative embodiment of the light tower 100 of the present invention. This embodiment of the tower 100 has substantially structure, function and features as the tower 10 of the previous embodiment, except that it additionally has a dome-style cap and audible buzzer. The dome-style cap may be opaque or clear/translucent if illumination is desired. The tower 100 includes a base assembly 101, a shell assembly 102 and a plurality of lens assemblies 103A/B to 107A/B, which again can vary depending upon the number of status indications desired to be illuminated and signaled. The tower 100 also has an elongated, cylindrical configuration. The base assembly 101 of the light tower 100 preferably principally comprises a cylindrical bottom base cap 120, a planar light array (not visible), and a top cap 122. The base cap 120 has a cylindrical configuration and is constructed of a durable, rigid material or composite material. The planar light array is disposed inside the shell assembly 102 and comprises a lighted printed circuit board (PCB) member and a plurality of sets of barriers which preferably consist of half barriers, and divide the lighted PCB member into light segments, each with two sides. Significantly, the lighted PCB member also has a flat, planar structure with a predetermined width and a predetermined length that is variable depending upon the number of indication sets and lens assemblies. The lighted PCB member has a plurality of light sources disposed on each side. In the preferred embodiment, the light sources are also light emitting diodes (LEDs). The shell assembly 112 has a cylindrical configuration with a bottom region 160 that has a wall with no apertures and a top region 161 with hemi-cylindrical aperture sets that expose the light clusters of the base assembly 111. Lens assemblies cover the aperture sets. Each lens assembly includes a sealing gasket, a diffusing film and a lens.

Figure 14A:
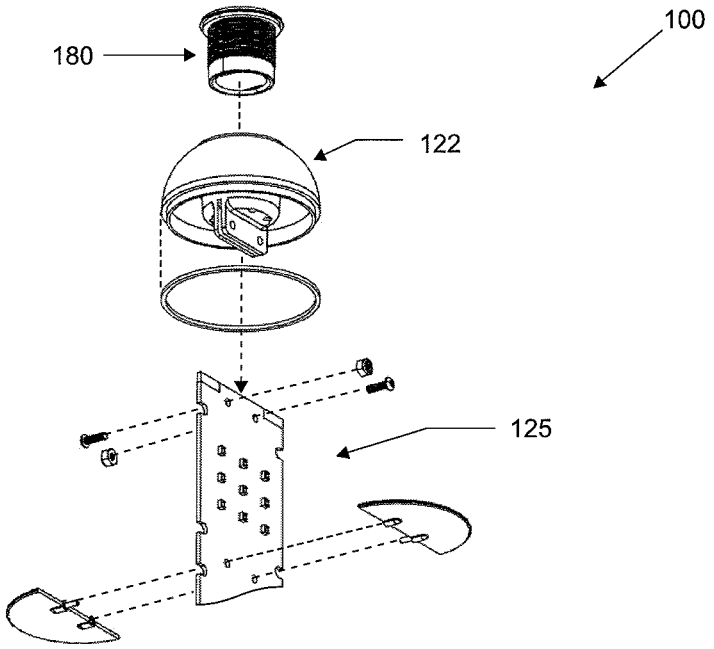
FIG. 14*a* is a partial view of an embodiment of the PCB sub-assembly with an optional buzzer and opaque cap.
Figure 14B:
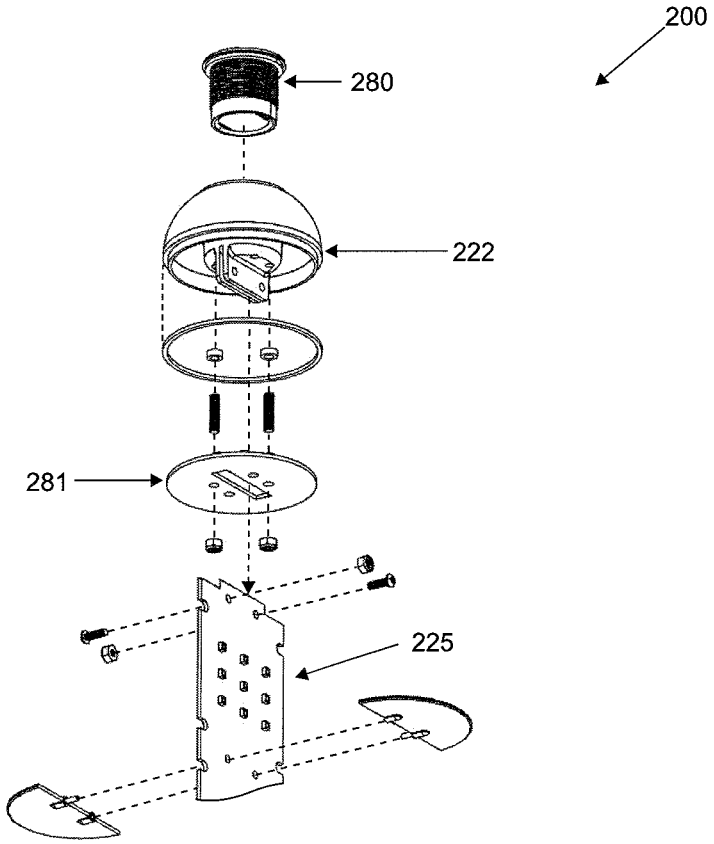
FIG. 14*b* is a partial view of a PCB sub-assembly with an optional buzzer and illuminated cap.
Figure 18:
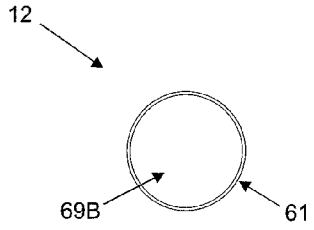
FIG. 18 is a top view thereof.
Figure 15:
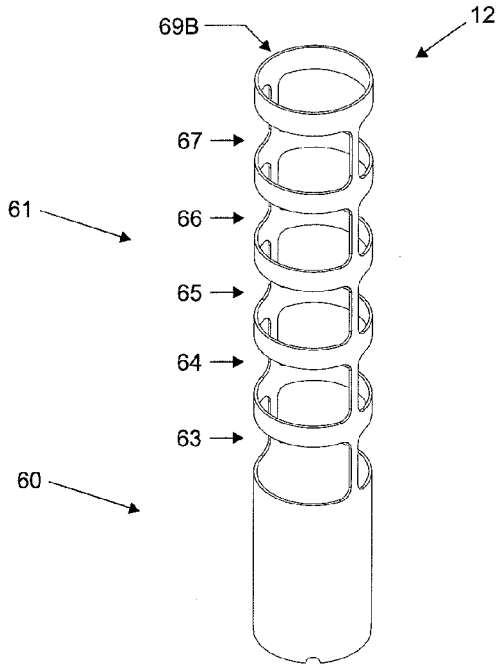
FIG. 15 is a perspective view of an embodiment of the shell of the light tower.
Figure 16:
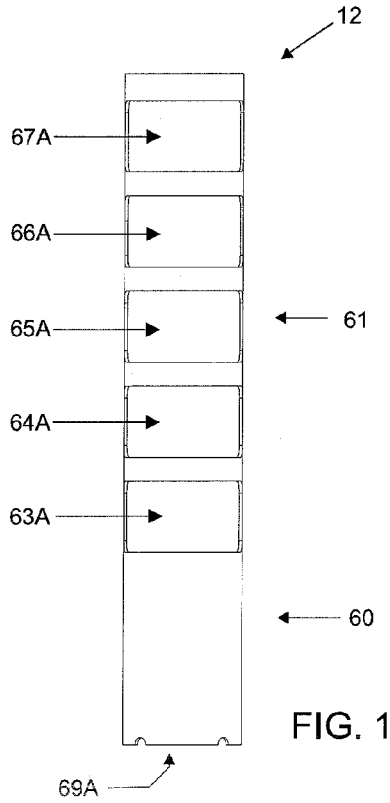
FIG. 16 is a front view thereof.
Figure 17:
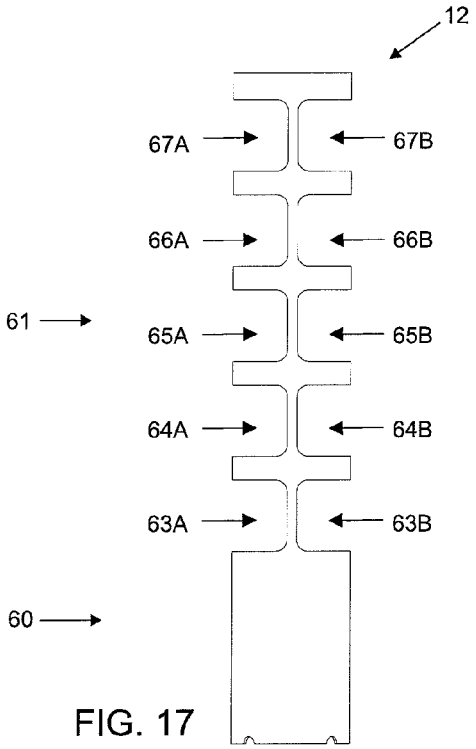
FIG. 17 is a side view thereof.
Figure 22:
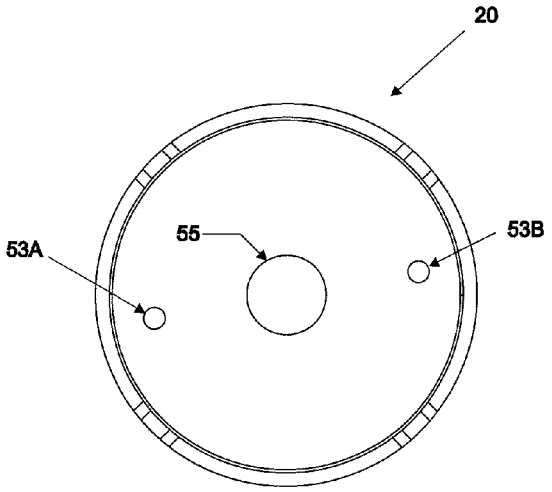
FIG. 22 is a top view thereof.
Figure 19:
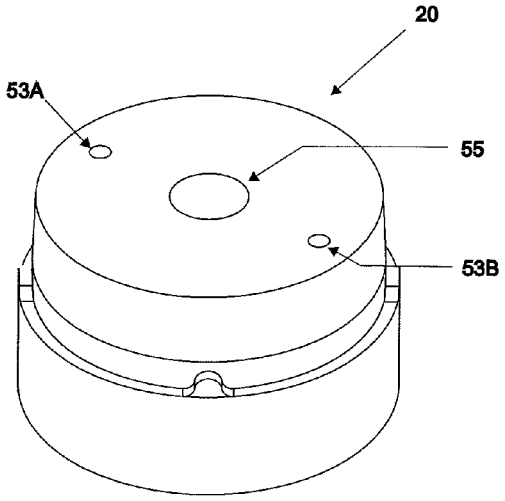
FIG. 19 is a perspective view of an embodiment of an embodiment of a base of the light tower of the invention.
Figure 20:
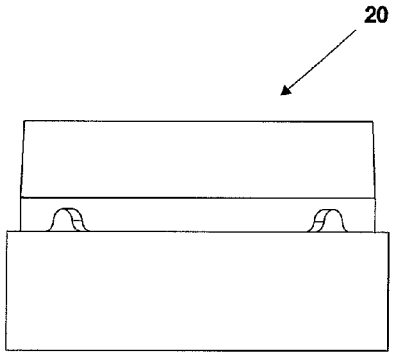
FIG. 20 is a front view thereof.
Figure 21:
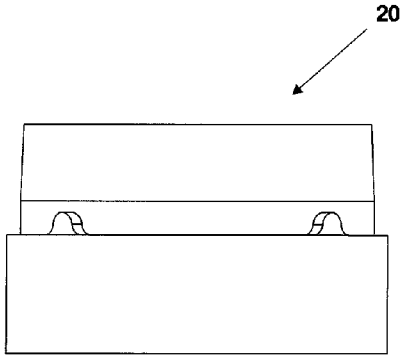
FIG. 21 is a side view thereof.

Referring also to FIG. 14A, the light tower 100 with a dome style cap 122 also preferably includes an audible buzzer 180. The buzzer 180 preferably has a volume control baffle. The sound transducer may be disposed at the top with the baffle, or the transducer may be disposed below, for example in association with the PCB 125. An exemplary buzzer 180 is a Floyd Bell #TMC-V86-531-W. Cap 122 is opaque. The cap 122 is connected to board 125. FIG. 14B shows an embodiment of the tower 200 including a dome style cap 222 and an audible buzzer 280. The cap 222 is clear (but may be translucent) so that it can transmit light from an additional indicator. Illuminated cap PCB 281 is electrically communicatively connected to main PCB 225 and serves as the additional illumination element. One or an array of LEDs (not shown) are disposed on the top surface of the PCT 281.

FIGS. 15-18 show details of the shell assembly 21 embodiment. The shell 21 has a rigid, cylindrical configuration with the bottom portion 60 and top portion 61. Apertures 63-67 form a skeleton type configuration at the top portion 61. Lens assemblies 13-17 cover the apertures 63-67 as described above. Aperture 69A is disposed at the bottom of the shell 21. Aperture 69B is disposed at the top of the shell 21.

FIGS. 19-22 show details of the base 20 embodiment. The base 20 preferably has a cylindrical configuration. A preferred material is die cast aluminum.

Figure 24:
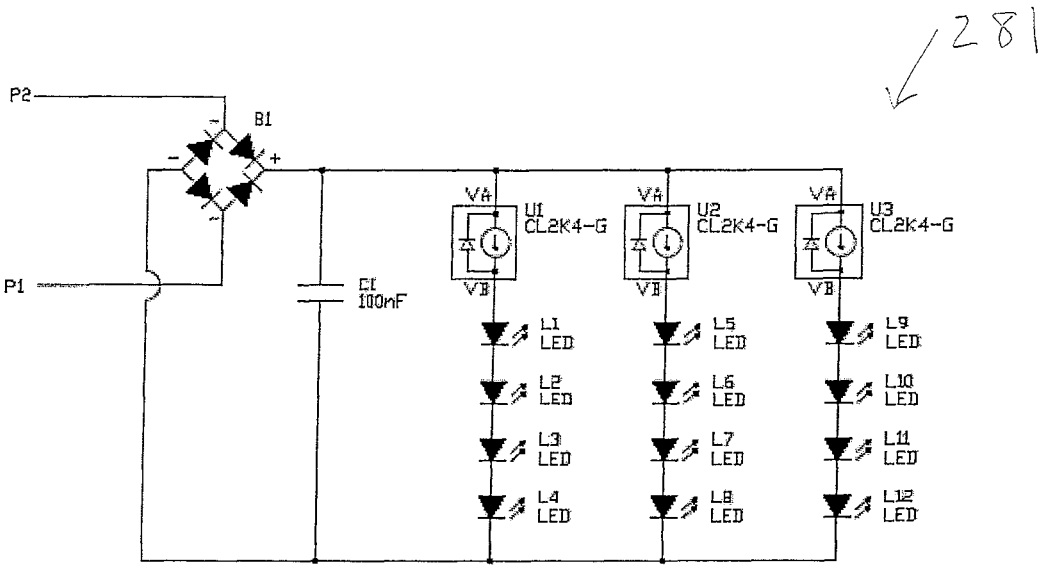
FIG. 24 is a schematic diagram of an embodiment of the circuitry of an optional illuminated cap.
Figure 25:
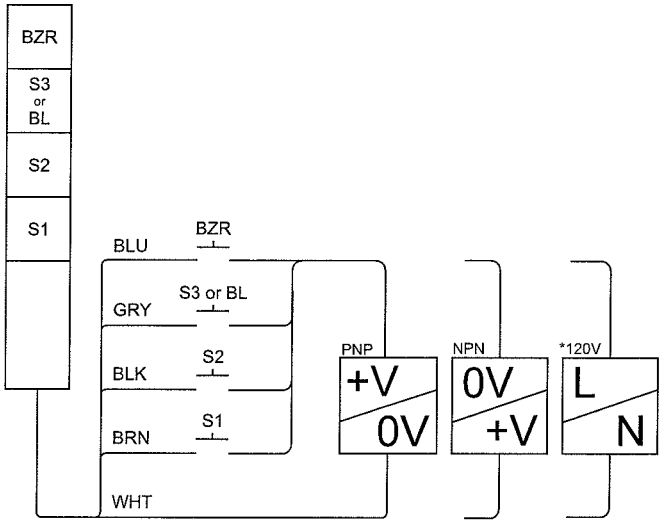
FIG. 25 illustrates an embodiment of a wiring diagram for light towers having between 1 and 3 segments.
Figure 26:
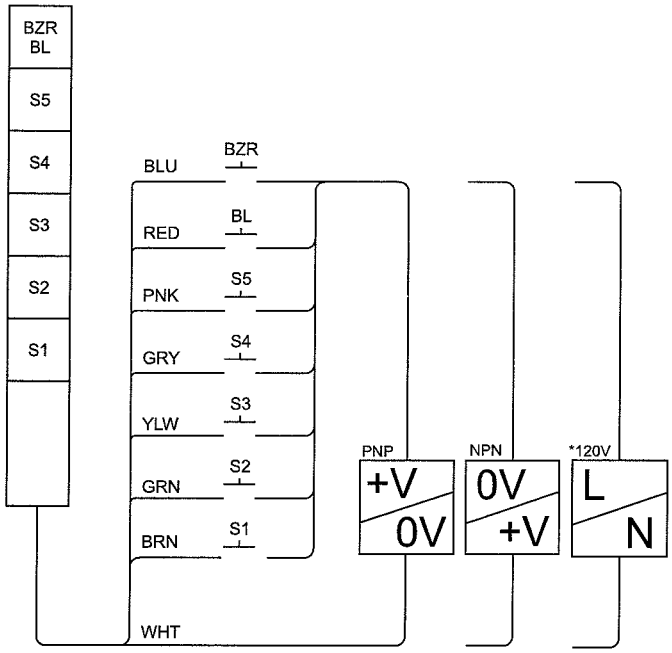
FIG. 26 illustrates an embodiment of a wiring diagram for light tower having 4-5 segments.
Figure 27:
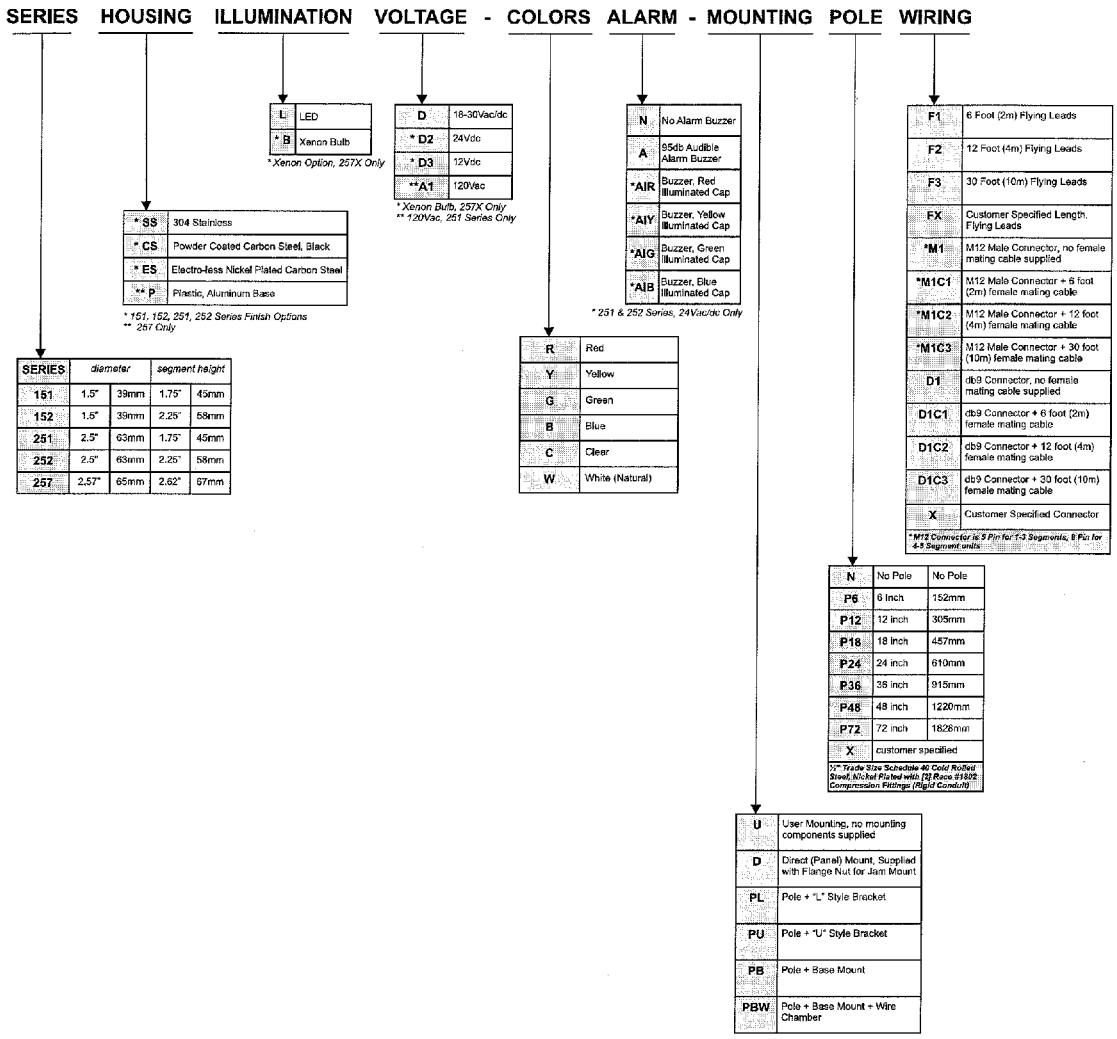
FIG. 27 is a chart showing particular arrangements of light towers with respect to housing, illumination, voltage, color, alarm, mounting, pole and wiring configurations.

FIG. 23 is an embodiment of the circuitry of the light tower which is configured on the PCB 25 shown for example in FIGS. 6-8. FIG. 24 is an embodiment of the circuitry for an optional illuminated cap which is configured on the PCB 281 shown in FIG. 14B. FIG. 25 illustrates an embodiment of a wiring diagram for light towers having between 1 and 3 segments. FIG. 26 illustrates an embodiment of a wiring diagram for light tower having 4-5 segments. FIG. 27 is a chart showing exemplary arrangements of housings, illumination, voltage, color, alarms, mounting, pole and wiring configurations consistent with the teachings of the invention.

In summary, the invention provides an indicator device or apparatus which has a flat PCB populated with LED's, mounted in a vertical orientation and a lens and/or film with diffusing capacity, that illuminates in a visually even way around a radial, horizontal plane. The radius of horizontal illumination can be 180 or 360 degrees. Preferably, the device illuminates around a 360 degree radius. It is within purview of the invention that a wall mount unit could be illuminating around a 180 Degree radius. If illuminating around 180 degrees, only one side of the PCB is populated with LED's. If illuminating around 360 degrees, both sides of the PCB are populated with LED's. A diffusing material is used to more evenly present the light. This permits the use of the flat, vertically oriented Printed Circuit Board (PCB), which provides a significant advantage in performance. The arrangement removes or drastically reduces the "hot spot's" that one would see visually from the LED's. It also disperses the light around the radius so that someone standing on the side of the unit (what would be the side/edge of the PCB) sees the same or similar amount of illumination as the person standing perpendicular to the PCB orientation. The arrangement also provides distinct ease of manufacturing advantage compared with known light indicators and methods. The diffusing material of the invention can be a film liner that is put inside the lens, such as a light diffusing, Optical Compensation Film available from Optigrafix Plastics of Maple Heights, Ohio USA. The diffuser or diffusing material may also be the lens itself, or something incorporated into the lens, for example a polycarbonate compound available from RTP, Inc., instead of a film applied to the lens.

The embodiments above are chosen, described and illustrated so that persons skilled in the art will be able to understand the invention and the manner and process of making and using it. The descriptions and the accompanying drawings should be interpreted in the illustrative and not the exhaustive or limited sense. The invention is not intended to be limited to the exact forms disclosed. While the application attempts to disclose all of the embodiments of the invention that are reasonably foreseeable, there may be unforeseeable insubstantial modifications that remain as equivalents. It should be understood by persons skilled in the art that there may be other embodiments than those disclosed which fall within the scope of the invention as defined by the claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

The invention claimed is:

1. A light indicator comprising:

a. a flat, planar, PCB light panel having two sides, the light panel further having a plurality of LED light sources disposed on each side of the light panel, the light sources being disposed in groups having at least two light sources per group;

b. a curvilinear light dispersing lens disposed near each group of one light sources to disperse light emitted from the at least one light source over a range of at least 360 degrees;

c. a frame for holding each light dispersing lens; and d. means to actuate the light source.

2. The light indicator of claim 1, wherein the light panel is oriented vertically.

3. The light indicator of claim 2, further comprising a base for holding the light panel in the vertical orientation.

4. The light indicator of claim 1, wherein the light panel includes a printed circuit board.

5. The light indicator of claim 1, wherein each light source, is associated with a predetermined event, characteristic or state of an apparatus or process, whereby the illumination of a light source or a combination of light sources visually indicates the status of the apparatus or process.

6. The light indicator of claim 1, wherein the light dispersing lens has a semi-cylindrical geometry.

7. The light indicator of claim 1, wherein the light dispersing lens comprises at least one film member and at least one rigid, light transmissive cover member.

8. The light indicator of claim 7, wherein the film member is a light diffusing, optical compensation film.

9. The light indicator of claim 7, wherein the rigid cover member is a clear or translucent polycarbonate lens.

10. The light indicator of claim 7, wherein the light dispersing lens is supported by a frame structure proximate the light source.

11. The light indicator of claim 10, wherein the frame structure has a cylindrical geometry.

12. The light indicator of claim 1, wherein the means to actuate the light source comprises circuitry integrated into the PCB.

13. The light indicator of claim 1, further comprising means to block light emitted from one group from interfering with light emitted from any adjacent groups.

14. A light indicator tower for use with a industrial apparatus or process to indicate the status of the apparatus or process, comprising:

a. a flat, planar, PCB light panel having two sides, the light panel further having a plurality of LED light sources disposed on each side of the light panel, the light sources being disposed in groups having at least two light sources per group, the groups of light sources being spatially separated a predetermined distance;

b. a curvilinear light dispersing lens disposed near each group of one light sources to disperse light emitted from the at least one light source over a range of at least 360 degrees, each light dispersing lens including a light dispersing film member and a rigid, light transmissive cover member;

c. a cylindrical frame for holding the light panel in a vertical orientation and for holding each light dispersing lens proximate a group of light sources, the frame having a base electrically communicatively connected to a bottom end of the PCB light panel and a lens supporting array vertically and upwardly extending from the base, the lens supporting array having a plurality of apertures for supporting the light dispersing lenses; and d. means, integrated into the PCB light panel, to actuate the groups of light sources and indicate the status of the apparatus or process.

* * * * *